US007665831B2

(12) United States Patent
Mita

(10) Patent No.: US 7,665,831 B2
(45) Date of Patent: Feb. 23, 2010

(54) IMAGE FORMING APPARATUS AND METHOD OF DRIVING INK DISCHARGE

(75) Inventor: Tsuyoshi Mita, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 137 days.

(21) Appl. No.: 10/950,419

(22) Filed: Sep. 28, 2004

(65) Prior Publication Data

US 2005/0088490 A1 Apr. 28, 2005

(30) Foreign Application Priority Data

Sep. 29, 2003 (JP) ..... 2003-338833

(51) Int. Cl.
*B41J 2/45* (2006.01)
*B41J 29/38* (2006.01)

(52) U.S. Cl. ..... 347/70; 347/9

(58) Field of Classification Search ..... 347/68
See application file for complete search history.

(56) References Cited

U.S. PATENT DOCUMENTS

| | | | | |
|---|---|---|---|---|
| 4,714,935 | A * | 12/1987 | Yamamoto et al. | 347/10 |
| 5,146,236 | A * | 9/1992 | Hirata et al. | 347/12 |
| 5,818,473 | A * | 10/1998 | Fujii et al. | 347/11 |
| 6,190,006 | B1 * | 2/2001 | Kurashima et al. | 347/70 |
| 6,309,056 | B1 * | 10/2001 | Sando et al. | 347/70 |
| 6,676,238 | B2 * | 1/2004 | Fujimura et al. | 347/11 |
| 6,971,737 | B2 * | 12/2005 | Sugahara | 347/68 |
| 7,222,942 | B2 * | 5/2007 | Kawamura | 347/68 |
| 2001/0055051 | A1 * | 12/2001 | Seto | 347/70 |

FOREIGN PATENT DOCUMENTS

| | | | |
|---|---|---|---|
| EP | 0 752 312 | A1 | 1/1997 |
| EP | 1 070 589 | A2 | 1/2001 |
| JP | 2-58280 | A | 2/1990 |
| JP | 2-141245 | A | 5/1990 |
| JP | 7-76084 | A | 3/1995 |
| JP | 07 076084 | A | 3/1995 |
| JP | 10-235861 | A | 9/1998 |
| JP | 10-264382 | A | 10/1998 |
| JP | 2002-292864 | A | 10/2002 |

* cited by examiner

*Primary Examiner*—Matthew Luu
*Assistant Examiner*—Shelby Fidler
(74) *Attorney, Agent, or Firm*—Birch, Stewart, Kolasch & Birch, LLP

(57) ABSTRACT

The image forming apparatus in which a plurality of ink chambers filled with ink are aligned, said ink chambers being expanded or contracted and ink being discharged from nozzles of the ink chambers onto a recording medium, by applying a voltage to piezoelectric elements provided on the outer perimeter or the outer side of the ink chambers, wherein said piezoelectric elements are arranged in a substantially parallel plane to the nozzle surface; and shorting devices which short the electrodes of said piezoelectric elements are provided.

8 Claims, 10 Drawing Sheets

IMAGE FORMING APPARATUS AND METHOD OF DRIVING INK DISCHARGE

This Non-provisional application claims priority under 35 U.S.C. § 119(a) on Patent Application No(s). 2003-338833 filed in Japan on Sep. 29, 2003, the entire contents of which are hereby incorporated by reference.

BACKGROUND OF THE INVENTION

1. Field of the Invention

The present invention relates to an image forming apparatus, and more particularly to an image forming apparatus for forming images on a recording medium by expanding and contracting ink chambers by means of piezoelectric elements and discharging ink from nozzles of the ink chambers.

2. Description of the Related Art

An image forming apparatus such as an inkjet printer forms images on recording paper by discharging ink onto the recording paper from a recording head, while relatively moving the recording head and the recording paper. The ink discharging device discharges ink from a nozzle formed in an ink chamber, by deforming the ink chamber by means of a piezoelectric element. However, in ink discharging devices of this kind, there is a problem of accidental drops, and the like, caused by cross-talk between adjacently positioned ink chambers. In order to resolve this problem, a technology for performing share mode driving where adjacent ink chambers are driven at staggered ink discharge timings is known (see Japanese Patent Application Publication No. 7-76084). This image forming apparatus causes the respective pillars on either side of each ink chamber to deform simultaneously, by generating a potential difference in these pillars. This deformation causes the ink chamber to expand or contract, and hence ink is discharged from the nozzle. If an ink chamber is not supposed to discharge ink, then the potential difference is set to zero at the respective electrodes of the pillars of the ink chamber, thereby preventing deformation of the ink chamber. In this way, accidental drops emitted by an ink chamber that is not supposed to discharge ink are prevented.

SUMMARY OF THE INVENTION

However, in an image forming apparatus of this kind, there is a drawback in that ink cannot be discharged simultaneously from adjacent nozzles in the case of the aforementioned share mode driving, and therefore increased image quality cannot be anticipated. Furthermore, although deformation is prevented in the pillars in the ink chamber adjacent to the ink chamber being expanded or contracted, no beneficial effect is obtained in respect of preventing warping in a line type head of long dimensions.

The present invention is devised with the foregoing in view, an object thereof being to provide an image forming apparatus which can prevent warping of a long line head, while also recording images of high quality.

In order to achieve the aforementioned object, the first aspect of the present invention is an image forming apparatus in which a plurality of ink chambers filled with ink are aligned, the ink chambers being expanded or contracted and ink being discharged from nozzles of the ink chambers onto a recording medium, by applying a voltage to piezoelectric elements provided on an outer perimeter or an outer side of the ink chambers, wherein the piezoelectric elements are arranged in a substantially parallel plane to the nozzle surface; and shorting devices which short electrodes of the piezoelectric elements are provided.

According to the first aspect of the present invention, the piezoelectric elements are disposed in a plane substantially parallel to the nozzle surface and shorting devices are provided at each ink chamber. In the present invention, provided that the electrodes of the piezoelectric elements at ink chambers of nozzles that are not supposed to discharge ink are shorted, thereby setting the electrodes to the same potential, then it is possible to prevent deformation of the piezoelectric elements in these ink chambers. Therefore, cross-talk can be prevented. Moreover, since the basic rigidity of the piezoelectric elements can be ensured by shorting the electrodes of the piezoelectric elements, then it is possible to prevent bending of a long, line type head in the longitudinal direction. Furthermore, ink can be discharged from the nozzle of an ink chamber adjacent to another ink chamber whose nozzle is to discharge ink. Therefore, image quality can be improved.

Preferably, in the first aspect of the present invention, the electrodes of the piezoelectric elements of ink chambers that are not to discharge ink are shorted by the shorting devices during image formation. Therefore, cross-talk to ink chambers which are not to discharge ink can be prevented.

Preferably, in the first aspect of the present invention, switching elements for switching shorting on and off are provided in the shorting devices.

Preferably, in the first aspect of the present invention, the shorting devices short the electrodes of the piezoelectric elements constantly, when the power supply is switched off, or when the apparatus is at standby for printing. Therefore, the rigidity of the piezoelectric elements can be ensured when no image is being formed. Moreover, it is also possible to prevent bending of the image forming apparatus in the longitudinal direction due to deformation of the piezoelectric elements caused by the electromotive force. Furthermore, a potential difference is prevented from occurring between the respective electrodes of the piezoelectric elements, thereby reducing the load on the circuit and protecting the circuit.

Preferably, in the first aspect of the present invention, the piezoelectric elements are provided with electrodes disposed above the partitions dividing the plurality of adjacently positioned pressure chambers; and shorting devices which shorts these electrodes are provided. Therefore, the rigidity of wall sections of the ink chambers can be ensured by means of the piezoelectric elements, and hence the rigidity of a line type recording head can be improved in the longitudinal direction.

In order to achieve the aforementioned object, the second aspect of the present invention is a method of driving ink discharge, in which a plurality of ink chambers filled with ink are aligned, the ink chambers being expanded or contracted and ink being discharged from nozzles of the ink chambers onto a recording medium, by applying a voltage to piezoelectric elements provided on the outer perimeter or the outer side of the ink chambers, comprising: shorting electrodes of the piezoelectric elements in ink chambers that are not to discharge ink by shorting devices during image formation.

According to the second aspect of the present invention, in a method of driving ink discharge, the electrodes of the piezoelectric elements of ink chambers that are not to discharge ink are shorted by the shorting devices during image formation. Therefore, cross-talk to ink chambers which are not to discharge ink can be prevented.

In order to achieve the aforementioned object, the third aspect of the present invention is a method of driving ink discharge, in which a plurality of ink chambers filled with ink are aligned, the ink chambers being expanded or contracted and ink being discharged from nozzles of the ink chambers onto a recording medium, by applying a voltage to piezoelectric elements provided on the outer perimeter or the outer side of the ink chambers, comprising: shorting constantly electrodes of the piezoelectric elements by shorting devices, when the power supply is switched off or when the apparatus is at standby for printing.

According to the third aspect of the present invention, in a method of driving ink discharge, the electrodes of the piezoelectric elements are shorted constantly by the shorting devices, when the power supply is switched off or when the apparatus is at standby for printing. Therefore, the rigidity of the piezoelectric elements can be ensured when no image is being formed. Moreover, it is also possible to prevent bending of the image forming apparatus in the longitudinal direction due to deformation of the piezoelectric elements caused by the electromotive force. Furthermore, a potential difference is prevented from occurring between the respective electrodes of the piezoelectric elements, thereby reducing the load on the circuit and protecting the circuit.

The piezoelectric elements generate a pressure wave by deforming in the transverse direction (d31). Therefore, the basic rigidity of the piezoelectric elements is ensured and bending of the recording head in the longitudinal direction can be prevented. Furthermore, if a plurality of nozzles are arranged in a full line array through a length corresponding to the full width of the recording medium, then it is possible to prevent cross-talk and therefore to prevent the occurrence of accidental drops, or the like. Moreover, a long, full line type recording head producing high image quality can be formed.

In the present invention, the term "recording" indicates the concept of forming images in a broad sense, including text. Moreover, "recording medium" indicates a medium on which an image is formed by means of a recording head (this medium may be called an image forming medium, recording medium, image receiving medium, recording paper, or the like), and this term includes various types of media, irrespective of material and size, such as continuous paper, cut paper, sealed paper, resin sheets, such as OHP sheets, film, cloth, and other materials.

According to the present invention, it is possible to prevent warping of a long, line type recording head. Furthermore, adjacent ink chambers can be operated and high quality images can be formed.

DETAILED DESCRIPTION OF THE PREFERRED EMBODIMENTS

Below, an embodiment of an image forming apparatus relating to the present invention is described with reference to the accompanying drawings.

Figure 1:
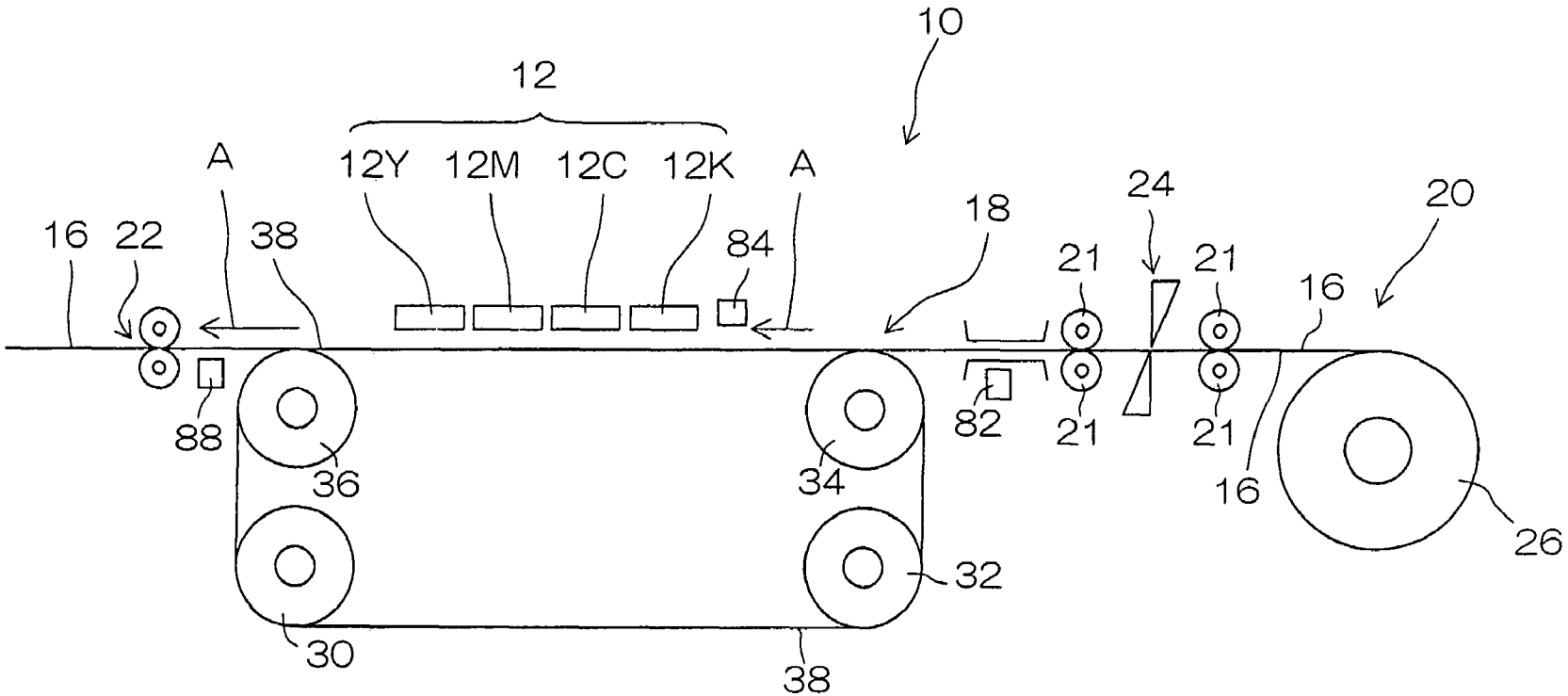
FIG. 1 is a side view showing an image forming apparatus to which an image forming apparatus relating to an embodiment of the present invention is applied.

In FIG. 1, The image forming apparatus 10 comprises a recording head 12, a belt conveyance unit 18 for conveying recording paper 16 while maintaining the recording paper 16 in a flat state, disposed in a position opposing the recording head 12, a paper supply unit 20 for supplying recording paper 16, and a paper output section 22 for outputting recording paper externally, once an image has been formed thereon.

Figure 2:
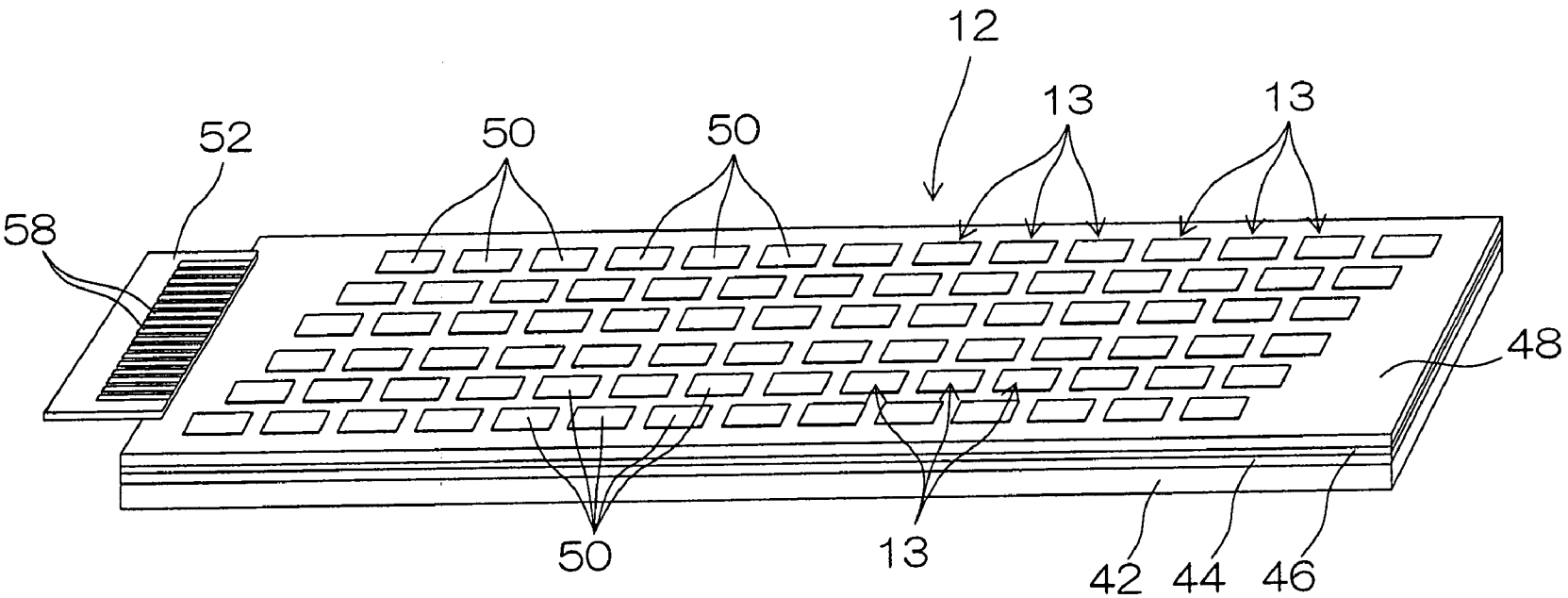
FIG. 2 is an oblique view showing a recording head which forms an image forming apparatus relating to an embodiment of the present invention.

The recording head 12 is constituted by a so-called full line type head, wherein a line type head having a length corresponding to the width of the recording paper 16 is disposed in a fixed position, in a direction orthogonal to the paper conveyance direction. Recording heads 12K, 12C, 12M, 12Y corresponding to respective ink colors are disposed in the order, black (K), cyan (C), magenta (M) and yellow (Y), from the upstream side, following the direction of conveyance of the recording paper 16 (shown in arrow A in FIG. 1). These respective recording heads have ink units 13 disposed in a houndstooth arrangement, as illustrated in FIG. 2, and they form a color image, and the like, on the recording paper 16 by discharging inks of respective colors onto the recording paper 16, from the ink units 13, while the recording paper 16 is conveyed.

Roll paper 26 is set in place detachably on a paper supply unit 20. Pickup rollers 21 and 21 for picking up recording paper 16 from the roll paper 26 are provided in the vicinity of the paper supply unit 20. The force of a motor (not illustrated) is transmitted to at least one of the pick-up rollers 21 and 21, and the recording paper 16 picked up thereby is conveyed from right to left in FIG. 1. Numeral 24 is a shearing cutter disposed between the rollers 21 and 21, and the recording paper 16 picked up from the roller paper 26 is cut to a prescribed size by means of the cutter 24.

The belt conveyance unit 18 has a structure wherein an endless belt 38 is wound about rollers 30, 32, 34 and 36, and is composed in such a manner that at least the portion opposing the recording head 12 is a flat surface. The belt 38 has a broader width dimension than the width of the recording paper 16, and the recording paper 16 can be suctioned onto the surface of the belt 38. The drive force of a motor (not illustrated) is transmitted to at least one of the rollers 30, 32, 34 and 36 about which the belt 38 is wound, thereby driving the belt 38 in a clockwise direction in FIG. 1. Accordingly, the recording paper 16 suctioned onto the belt 38 is conveyed from right to left in FIG. 1.

Numeral 82 denotes a recording detection unit for reading in the position, size, and the like, of the recording paper 16, numeral 84 denotes a recording position detection unit for determining the timing of ink discharge onto the recording paper 16, and numeral 88 denotes a recording paper end detection unit for detecting jamming of the recording paper 16 and determining the timing for supplying the next sheet. Furthermore, a system controller (not illustrated) which controls the whole image forming apparatus 10 on the basis of the detection results from the respective detection units is provided in the image forming apparatus 10. The system controller is constituted by a central processing unit (CPU), peripheral circuits, and the like, and it generates drive signals and control signals for the respective motors for conveying the recording paper 16, and image forming signals for the recording head 12, for example.

Next, the structure of the recording head 12 will be described. Since each of the recording heads 12K, 12C, 12M and 12Y provided for the respective ink colors has a similar structure, below, a recording head indicated by the numeral 12 is described as a representative example of these respective recording heads.

Figure 3A:
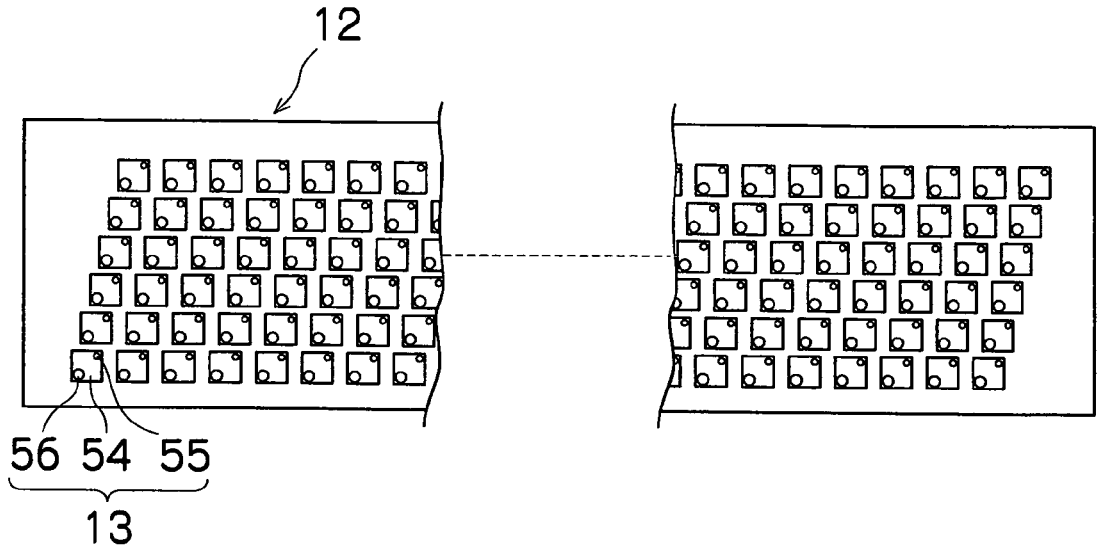
FIG. 3A and FIG. 3B are a plan view perspective diagram and an enlarged view showing a recording head which forms an image forming apparatus relating to an embodiment of the present invention.
Figure 3B:
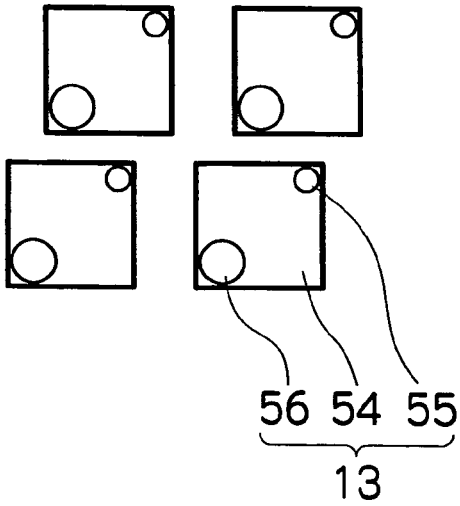
Figure 4:
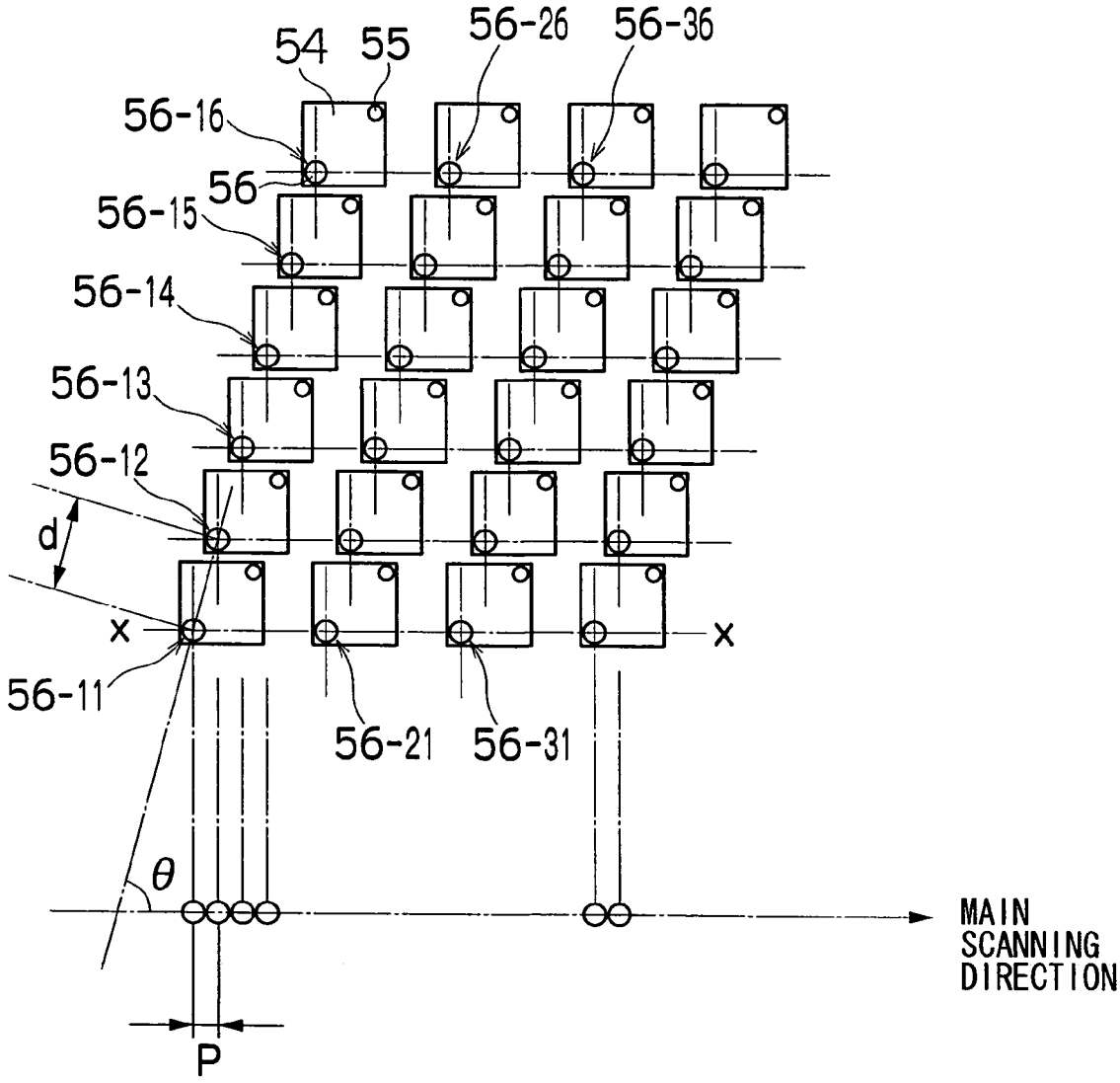
FIG. 4 is a partial enlarged view showing a recording head which forms an image forming apparatus relating to an embodiment of the present invention.

FIG. 2 is an oblique view showing an example of the structure of the recording head 12. FIG. 3A is a plan view perspective diagram and FIG. 3B is a partial enlarged view of same. FIG. 4 is a partial enlarged view of a portion of FIG. 3A, and FIG. 5 is a cross-section along x-x in FIG. 4.

In order to achieve a high density for the dot pitch formed onto the surface of the recording paper, it is necessary to achieve a high density in the nozzle pitch in the recording head 12. As shown in FIG. 3A, FIG. 3B and FIG. 4, the print head 12 according to the present example has a structure wherein a plurality of ink units 13, each comprising a nozzle 56 from which ink droplets are discharged, a pressure chamber 54 corresponding to the respective nozzle 56, and the like, are disposed in a hound's tooth matrix arrangement (a two-dimensional arrangement). Thereby, a high density is achieved in the apparent nozzle pitch. The pressure chambers 54 provided so as to correspond respectively to the nozzles 56 are formed by a cutting process, or the like. Each pressure chamber 54 is substantially square-shaped in plan view, and has a nozzle 56 and a supply port 56 provided respectively at symmetrically located corner sections. Each ink chamber 54 is connected to a common flow passage (not illustrated), by means of a supply port 55.

Figure 5:
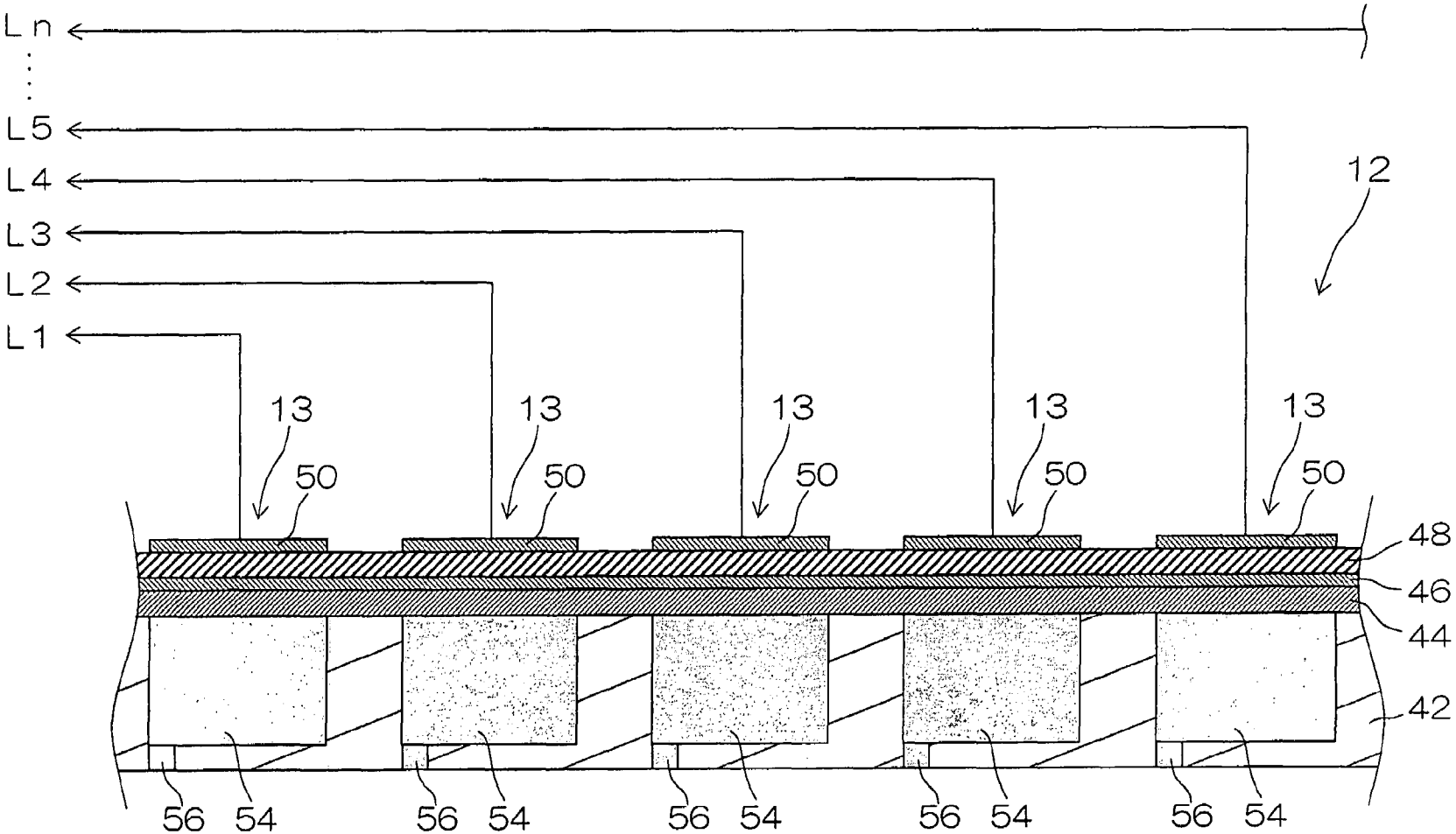
FIG. 5 is a cross-sectional diagram along x-x showing the detailed structure of a recording head which forms an image forming apparatus relating to an embodiment of the present invention.

In FIG. 5, the ink chambers 54 are provided in a flow passage forming member 42. A common electrode 46 connected to ground is installed on the upper portion of a vibration plate 44, which constitutes the upper face of the flow passage forming member 42, in other words, the ceilings of the ink chambers 54. Furthermore, a single plate-shaped piezoelectric element 48 is provided on the upper face of the common electrode 46. Individual electrodes 50 corresponding to the ink chambers 54 are installed on the upper face of the piezoelectric element 48.

When a drive voltage is applied to an individual electrode 50, the piezoelectric element 48 deforms and ink is discharged from the nozzle 56. When ink is discharged, new ink is supplied to the pressure chamber 54 from the common flow passage, via the supply port 55.

As shown in FIG. 4, the plurality of ink units 13 having this structure are composed in a lattice arrangement, based on a fixed arrangement pattern having a row direction which coincides with the main scanning direction, and a column direction which is inclined at a fixed angle of θ with respect to the main scanning direction, rather than being orthogonal to the main scanning direction. By adopting a structure wherein a plurality of ink chamber units 13 are arranged at a uniform pitch d in a direction forming an angle θ with respect to the main scanning direction, the pitch P of the nozzles when projected to align in the main scanning direction will be d×cos θ.

More specifically, the arrangement can be treated equivalently to one wherein the respective nozzles 56 (56-11, 56-12, 56-13, 56-14, 56-15, 56-16, . . . ) are arranged on a single straight line at uniform pitch P, in the main scanning direction. By means of this composition, it is possible to achieve a single-line nozzle arrangement of high density, wherein the nozzle columns projected to align in the main scanning direction reach a total of 2400 per inch (2400 nozzles per inch). Below, in order to facilitate the description, it is supposed that the nozzles 56 are linearly arranged at a uniform pitch (P), in the longitudinal direction of the head (main scanning direction).

In a full-line head having a row of nozzles which corresponds to the full width of the printing paper, when the nozzles are driven, either (1), all of the nozzles are driven simultaneously, or (2) the nozzles are driven successively from one side toward the other side, or (3) the nozzles are divided up into blocks and are driven successively in these blocks, from one side toward the other. This driving of the nozzles in order to print one line (a line formed of a row of dots, or a line formed of a plurality of rows of dots) in the width direction of the printing paper (the direction orthogonal to the direction of conveyance of the printing paper) is defined as main scanning.

In particular, when the nozzles 56 arranged in a matrix such as that shown in FIG. 4 are driven, the main scanning according to the above-described (3) is preferred. More specifically, the nozzles 56-11, 56-12, 56-13, 56-14, 56-15 and 56-16 are treated as a block (additionally; the nozzles 56-21, 56-22, . . . , 56-26 are treated as another block; the nozzles 56-31, 56-32, . . . , 56-36 are treated as another block, . . . ); and one line is printed in the width direction of the recording paper 16 by sequentially driving the nozzles 56-11, 56-12, . . . , 56-16 in accordance with the conveyance velocity of the recording paper 16.

On the other hand, the "sub-scanning" is defined as to repeatedly perform printing of one line (a line formed of a row of dots, or a line formed of a plurality of rows of dots) formed by the main scanning, while moving the full-line head and the recording paper relatively to each other.

In FIG. 2, a connection board 52 for making electrical connections with the system controller of the image forming apparatus 10 is provided at one end of the recording head 12. A conductive pattern 58 which is connected to each of the electrodes 50 in the recording head 12 is formed on the connection board 52.

Figure 6A:
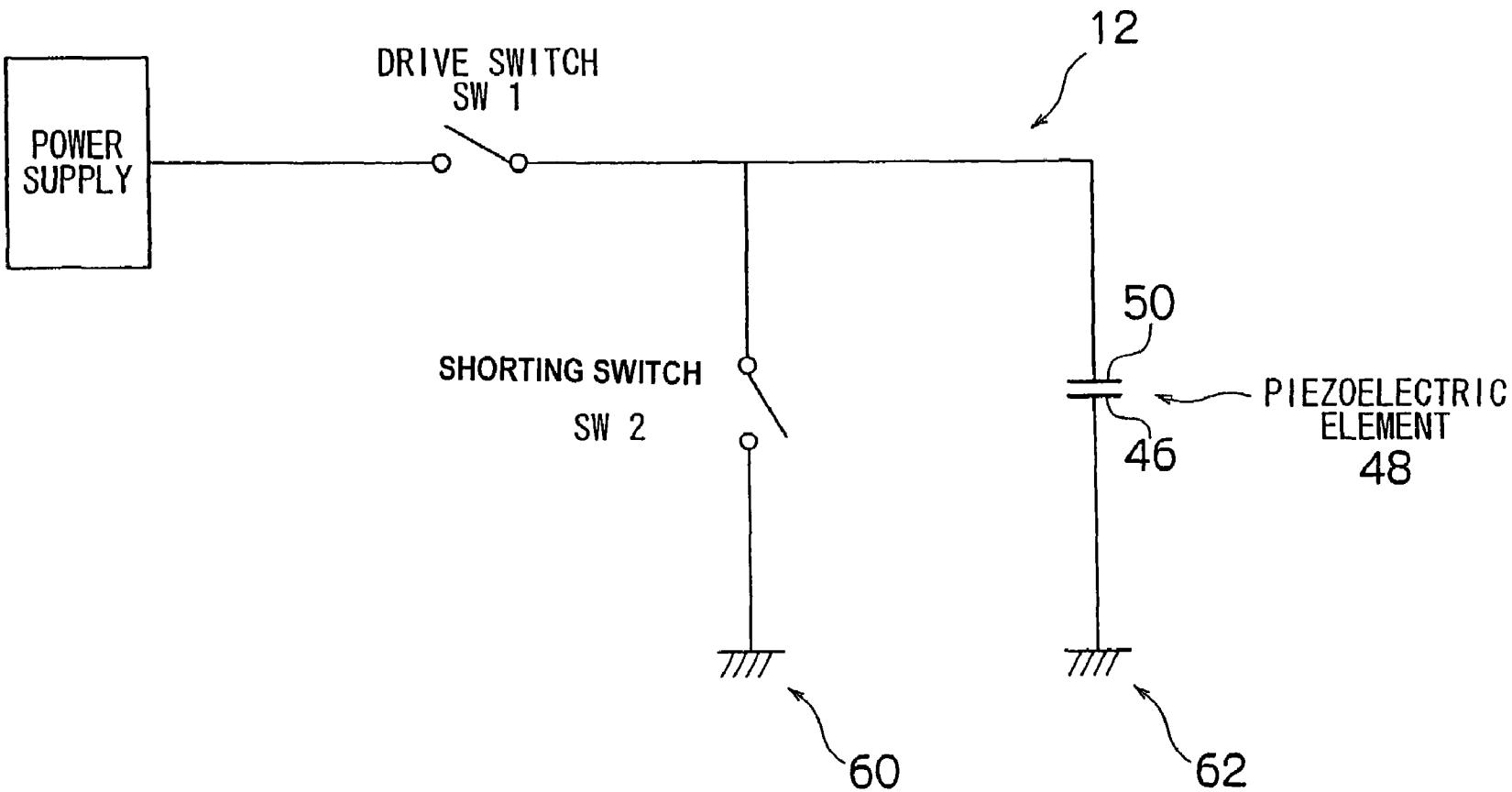
FIG. 6A is a diagram of the drive circuit of a piezoelectric element in a recording head which forms an image forming apparatus relating to an embodiment of the present invention.

FIG. 6A is a diagram of the drive circuit for the piezoelectric elements 48. The electrode 50 and the power supply are connected via a drive switch SW1, and the common electrode 46 is connected to ground by an earthing circuit 62. Furthermore, the electrode 50 and the common electrode 46 are grounded to an earthing circuit 60, via a shorting switch SW2 used to switch shorting on and off. The drive switch SW1 and the shorting switch SW2 are controlled by means of a system controller provided in the aforementioned image forming apparatus 10.

Figure 7:
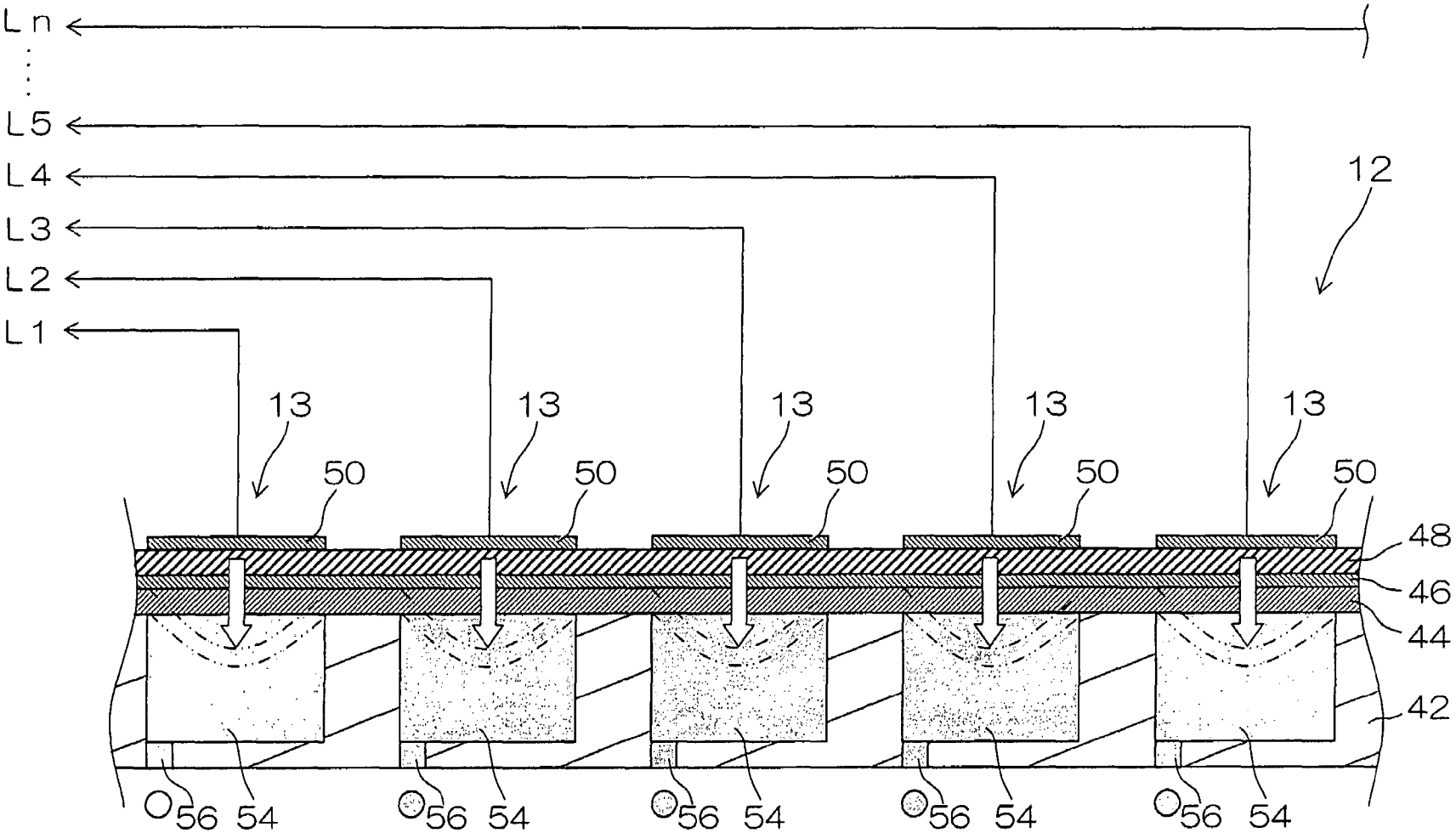
FIG. 7 is a partial enlarged cross-sectional diagram showing an action of a recording head which forms an image forming apparatus relating to an embodiment of the present invention.

When a voltage is applied to a piezoelectric element 48 in the recording head 12 having this composition, the piezoelectric element 48 deforms, the piezoelectric element 48 and the vibration plate 44 bend in the downward direction in FIG. 7. Consequently, the ink chamber 54 is contracted and ink is discharged from the nozzle 56. That is, in FIG. 6A, if a voltage is applied to the electrode 50 with the drive switch SW1 switched on and the shorting switch SW2 switched off, then a potential difference is generated between the electrodes 46 and 50, and the piezoelectric element 48 deforms. The vibration plate 44 deforms in conjunction with the deformation of the piezoelectric element 48, thereby changing the volume of the ink chamber 54, contracting the ink chamber 54, and thus discharging ink from the nozzle 56 (see FIG. 7).

Although not illustrated in the drawings, it is also possible to discharge ink from the nozzle 56 by causing the piezoelectric element 48 and the vibration plate 44 to bend upwards by applying voltage between the electrodes 46 and 50 and then returning the ink chamber 54 to its original state by shutting off the voltage.

Figure 6B:
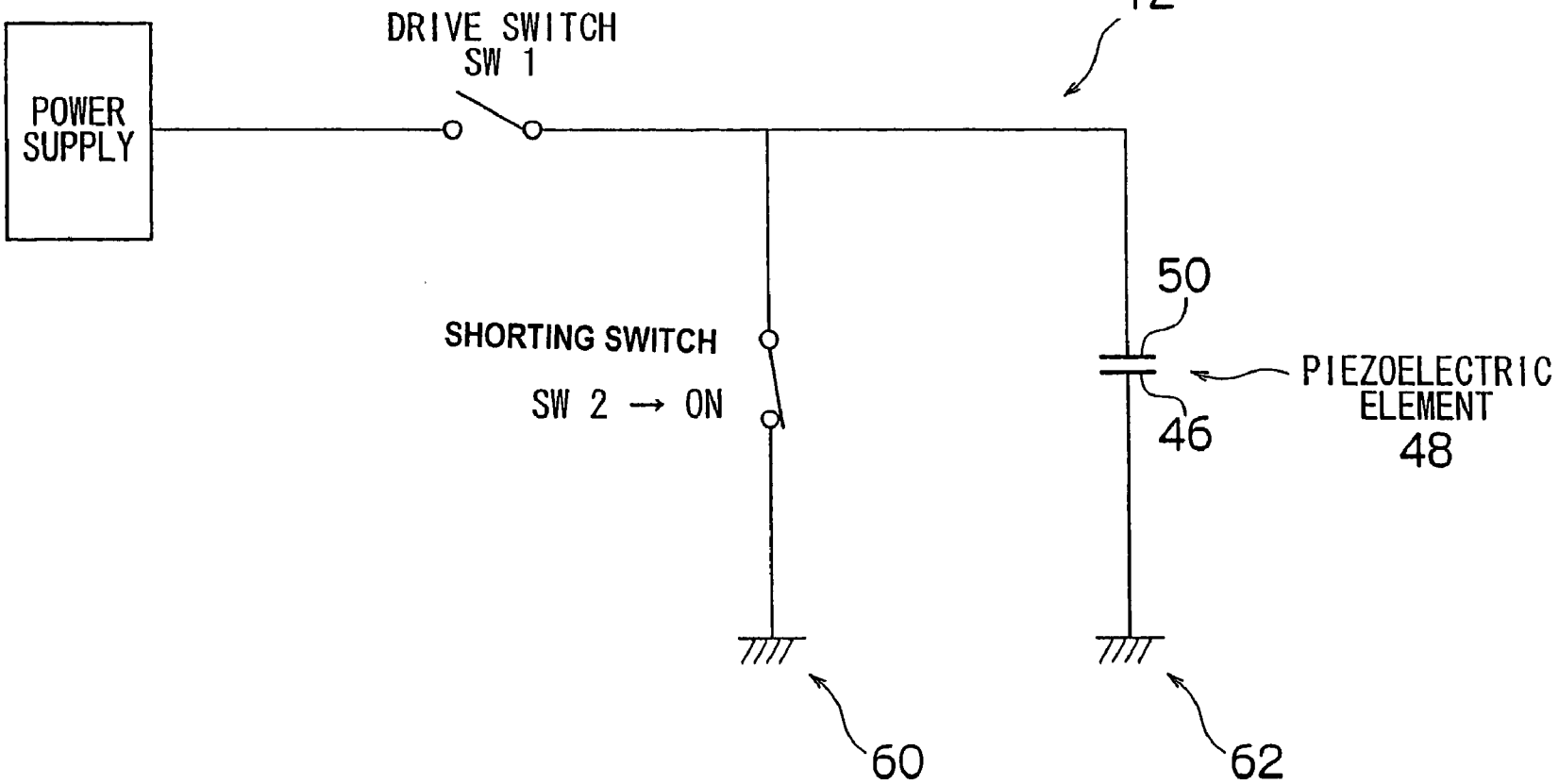
FIG. 6B is a circuit diagram showing status when the power supply to the image forming apparatus is switched off or when the image forming apparatus is waiting at standby for printing.

Moreover, as shown in FIG. 6B, if the drive switch SW1 is switched off and the shorting switch SW2 is switched on, then both electrodes of the piezoelectric element 48 will have the same electric potential, and therefore, deformation of the piezoelectric element 48 due to external physical force from outside the piezoelectric element 48, for example, can be prevented.

Next, the operation of the image forming apparatus having the composition described above will be explained.

By switching on the drive switch SW1, a voltage is applied to the electrode 50, from the power supply. The operation of discharging ink from the ink unit 13 when this drive voltage is applied will be described hereafter. Furthermore, the drive voltage is applied as a drive voltage pulse having a drive waveform based on an image forming pattern.

When the power supply to the image forming apparatus 10 is switched off, or when it is waiting at standby for image formation (i.e., when it is waiting at standby for printing), as shown in FIG. 6B, the drive switch SW1 is switched off and the shorting switch SW2 is switched on. Therefore, no drive voltage is applied to the electrodes 50 of the piezoelectric element 48. Consequently, as shown in FIG. 5, the piezoelectric elements 48 are not driven and no ink is discharged from the nozzles 56. In this case, the shorting switch SW2 is switched on continuously by the system controller, in such a manner that both electrodes of the piezoelectric elements 48 are grounded constantly. This ensures rigidity of the piezoelectric elements 48 when not forming images.

When ink is to be discharged from the ink chambers 54 in order to form an image on the basis of an image forming pattern, the system controller switches on the drive switch SW1 shown in FIG. 6, and it switches off the shorting switch SW2. Thereby, a drive voltage is applied to the electrodes 50 and the piezoelectric elements 48 deform as indicated by the double-dotted line in FIG. 7. Accordingly, the vibration plate 44 which corresponds to the ceiling of the respective ink chambers 54 bends so as to project into each ink chamber 54, and hence ink is discharged from the ink chambers, via the nozzles 56. The ink thus discharged is ejected in the form of droplets onto the recording face of the recording paper 16 (see FIG. 1), thereby forming an image on the recording paper 16. When application of the drive voltage is terminated, the piezoelectric elements 48 and the vibration plate 44 which have deformed in this way revert to their state prior to deformation. When they revert in this manner, new ink of approximately the same volume as the ink that has been discharged is supplied to the ink chambers 54 from an ink supply passage.

Figure 8:
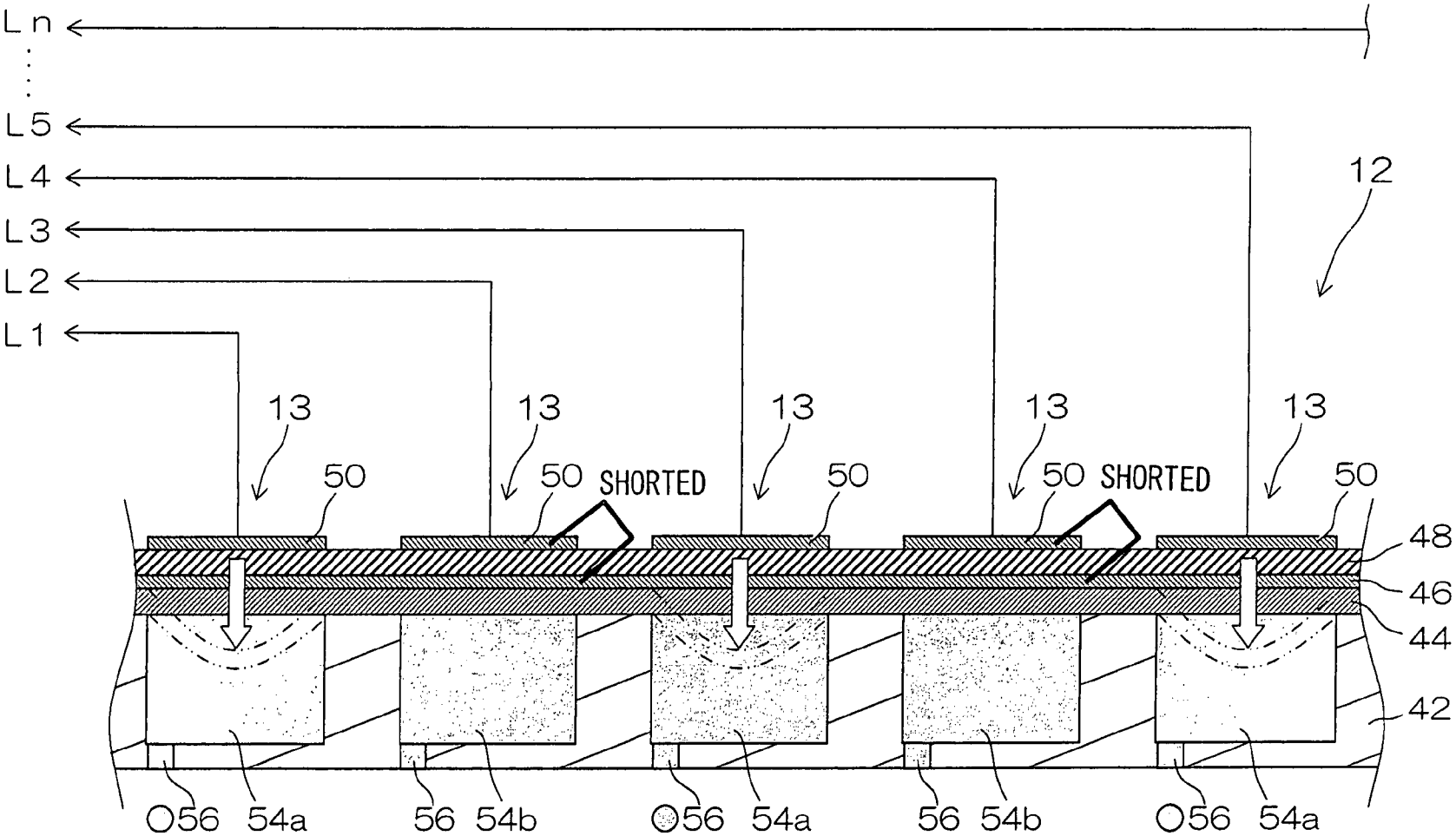
FIG. 8 is a partial enlarged cross-sectional diagram showing a further action of a recording head which forms an image forming apparatus relating to an embodiment of the present invention.

Next, a case is described where, due to the image forming pattern, ink chambers 54*a* that are to discharge ink are positioned adjacently to ink chambers 54*b* that are not to discharge ink, as illustrated in FIG. 8.

In this case, in synchronism with the drive timing of the drive voltage for discharging ink, the shorting switch SW2 is switched on at each adjacent ink chamber that is not to discharge ink, thereby grounding the electrode 50 and the common electrode. In other words, the system controller switches on the drive switch SW1 and switches off the shorting switch SW2 in the ink units of the ink chambers 54*a* that are to discharge ink. Simultaneously with this, the system controller switches off the drive switch SW1 and switches on the shorting switch SW2 in the ink unit of the ink chambers 54*b*.

Accordingly, in the ink chambers 54*a*, ink is discharged via the nozzles 56, whereas in the adjacent ink chambers 54*b*, the potential difference between the electrode 50 and the common electrode 46 of the piezoelectric element 48 corresponding to the ink chamber 54*b* is held at zero, thereby preventing deformation of the piezoelectric element 48. Therefore, since the original rigidity of the piezoelectric elements 48 corresponding to the ink chambers 54*b* can be maintained, it is possible to eliminate cross-talk from the ink chambers 54*a* to the ink chambers 54*b*, and hence discharge of accidental drops can be prevented.

This ink discharging operation is performed repeatedly, and an image based on an image forming pattern is formed on the recording paper 16 as it is conveyed.

As described above, according to the image forming apparatus of the present embodiment, ink can be discharged from the nozzles of ink chambers adjacent to other ink chambers 54 of nozzles 56 that are to discharge ink, and therefore image quality can be improved. Furthermore, in a piezoelectric element 48 at an ink chamber 54*b* of a nozzle 56 that is not to discharge ink, both electrodes are shorted and set to the same potential, thereby suppressing deformation of the piezoelectric element 48 at that ink chamber 54*b*. Consequently, cross-talk can be prevented and rigidity can be increased, thereby preventing warping in cases where the nozzles 56 of the recording head 12 are arranged in a full line array comprising a plurality of nozzles arranged through a length corresponding to the full width of the recording medium.

Next, the image forming apparatus according to a second embodiment of the present invention will be described. Elements which are the same or similar to those of the first embodiment illustrated in FIG. 5 are labeled with similar reference numerals and detailed description thereof is omitted here.

Figure 9:
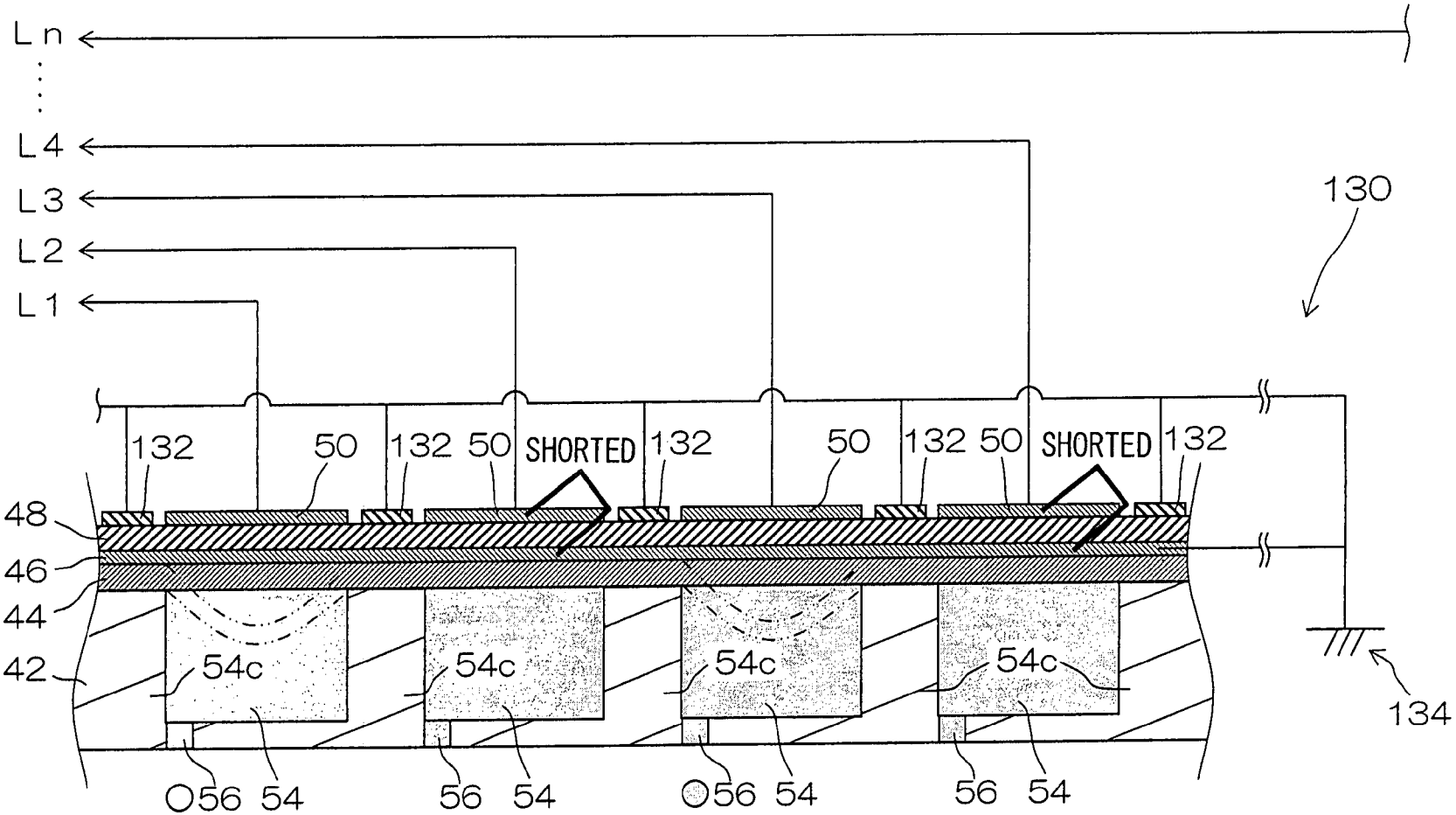
FIG. 9 is a partial enlarged cross-sectional diagram showing a further mode of a recording head which forms an image forming apparatus relating to an embodiment of the present invention.

As shown in FIG. 9, the recording head 130 according to the present embodiment has the composition of the recording head 12 and further comprises fixed electrodes 132 provided above the partitions 54*c* which respectively divide the plurality of adjacent ink chambers 54. These fixed electrodes 132 are installed on the piezoelectric elements 48, and each of the fixed electrodes 132 is connected to an earthing circuit 134. The common electrode 46 is also connected to the earthing circuit 134. Thereby, a shorting circuit is constituted which constantly shorts the fixed electrodes 132 of the piezoelectric elements 48 situated over the partitions 54*c*, to the common electrode 46.

To describe the operation of the recording head 130 having the aforementioned composition, when ink is discharged from nozzles 56 by applying a drive voltage to the electrodes 50, the potential difference between the fixed electrodes 132 of the piezoelectric elements 48 and the common electrodes 46 is held at zero, at all times. Therefore, deformation of the portions of the piezoelectric elements 48 situated above the partitions 54*c* dividing the plurality of adjacent ink chambers 54 is prevented. Consequently, it is possible to prevent cross-talk to ink chambers which are not to discharge ink. Furthermore, since the rigidity of the piezoelectric elements 48 in the portion above the partitions 54*c* can be ensured, then the longitudinal rigidity of a long recording head 12 can be increased further.

What is claimed is:

1. An image forming apparatus in which a plurality of ink chambers filled with ink are aligned, said ink chambers being expanded or contracted and ink being discharged from nozzles of the ink chambers onto a recording medium, by applying a voltage to piezoelectric elements provided on an outer perimeter or an outer side of the ink chambers, each piezoelectric element including first and second electrodes, wherein said piezoelectric elements are arranged in a plane substantially parallel to a nozzle surface in which said nozzles are formed;

a lower face of a common vibration plate constitutes a ceiling of the plurality of ink chambers;

the piezoelectric elements are constituted of a common plate-shaped piezoelectric member that is provided over the common vibration plate;

the piezoelectric elements deform in a $d_{31}$ mode to expand or contract the ink chambers;

a common electrode, corresponding to the first electrode, is provided on a bottom surface of the common plate-shaped piezoelectric member; and individual electrodes, corresponding to the second electrodes, are provided on an upper surface opposite to the bottom surface of the common plate-shaped piezoelectric member;

shorting devices which short said piezoelectric elements are provided, the shorting devices include shorting switches which make and break connection to shorting lines for shorting the piezoelectric elements, and drive switches are provided, the drive switches make and break connection to lines for applying the voltage to the piezoelectric elements, wherein when a drive switch connects a piezoelectric element to the line for applying voltage to the piezoelectric element, a shorting switch disconnects the piezoelectric element from the shorting lines, when a shorting switch connects the piezoelectric element to the shorting lines, the drive switch disconnects the piezoelectric element from the line for applying voltage, fixed electrodes are respectively disposed above partitions dividing the plurality of adjacently positioned pressure chambers and on the common plate-shaped piezoelectric member, and a shorting circuit for shorting the first electrode and each of the fixed electrodes is provided.

2. The image forming apparatus according to claim 1, wherein the first and second electrodes of said piezoelectric elements of ink chambers that are not to discharge ink are shorted by said shorting devices during image formation.

3. The image forming apparatus according to claim 2, wherein said shorting devices short the first and second electrodes of said piezoelectric elements to each other constantly, when a power supply to the image forming apparatus is switched off, or when the image forming apparatus is at standby for printing.

4. The image forming apparatus according to claim 1, wherein said shorting devices short the first and second electrodes of said piezoelectric elements to each other constantly, when a power supply to the image forming apparatus is switched off, or when the image forming apparatus is at standby for printing.

5. An image forming apparatus in which a plurality of ink chambers filled with ink are aligned, said ink chambers being expanded or contracted and ink being discharged from nozzles of the ink chambers onto a recording medium, by applying a voltage to piezoelectric elements provided on an outer perimeter or an outer side of the ink chambers, wherein:

said piezoelectric elements are arranged in a plane over a common vibration plate, the plane being substantially parallel to a nozzle surface in which said nozzles are formed;

said piezoelectric elements deform in a $d_{31}$ mode to respectively expand or contract the ink chambers;

said piezoelectric elements are constituted of a common plate-shaped piezoelectric member;

a common electrode is provided on a bottom surface of the common plate-shaped piezoelectric member;

individual electrodes are provided on an upper surface of the common plate-shaped piezoelectric member so as to respectively correspond to the ink chambers;

fixed electrodes are respectively disposed above partitions dividing the plurality of adjacently positioned pressure chambers and on the common plate-shaped piezoelectric member;

a shorting device which shorts or disconnects the common electrode and each of the individual electrodes is provided; and a shorting circuit which shorts the common electrode and each of the fixed electrodes is provided.

6. The image forming apparatus according to claim 5, wherein the common electrode and individual electrodes corresponding to ink chambers that are not to discharge ink are shorted by said shorting device during image formation.

7. The image forming apparatus according to claim 5, wherein switching elements for switching shorting on and off are provided in said shorting device.

8. The image forming apparatus according to claim 5, wherein said shorting device shorts the common electrode and the individual electrodes constantly to each other, when a power supply is switched off, or when the apparatus is at standby for printing.

* * * * *